US010787850B2

(12) United States Patent
Jeoung

(10) Patent No.: US 10,787,850 B2
(45) Date of Patent: Sep. 29, 2020

(54) SLIDING APPARATUS FOR SLIDING DOOR

(71) Applicant: Yong Il Jeoung, Gyeonggi-do (KR)

(72) Inventor: Yong Il Jeoung, Gyeonggi-do (KR)

( * ) Notice: Subject to any disclaimer, the term of this patent is extended or adjusted under 35 U.S.C. 154(b) by 93 days.

(21) Appl. No.: 16/087,869

(22) PCT Filed: Feb. 9, 2017

(86) PCT No.: PCT/KR2017/001430
§ 371 (c)(1),
(2) Date: Sep. 24, 2018

(87) PCT Pub. No.: WO2017/171227
PCT Pub. Date: Oct. 5, 2017

(65) Prior Publication Data

US 2019/0112856 A1 Apr. 18, 2019

(30) Foreign Application Priority Data

Mar. 31, 2016 (KR) ..... 10-2016-0039202

(51) Int. Cl.
*E05D 13/00* (2006.01)
*E05D 15/08* (2006.01)
(Continued)

(52) U.S. Cl.
CPC ..... *E05D 15/08* (2013.01); *E05D 15/06* (2013.01); *E05D 15/063* (2013.01);
(Continued)

(58) Field of Classification Search
CPC ..... E05D 15/08; E05D 15/06; E05D 15/0652; E05D 15/063; E05D 13/04;
(Continued)

(56) References Cited

U.S. PATENT DOCUMENTS 4,708,410 A * 11/1987 Mazaki ..... E05D 15/1065 312/138.1
6,094,866 A * 8/2000 Busnelli ..... E05D 15/1065 49/211
(Continued)

FOREIGN PATENT DOCUMENTS

JP 2002227507 8/2002
JP 2010101058 5/2010
(Continued)

*Primary Examiner* — Jerry E Redman
(74) *Attorney, Agent, or Firm* — IPLA P.A.; James E. Barne

(57) ABSTRACT

A sliding apparatus for a sliding door comprises: a front top roller part including an upper outer bracket and an upper inner bracket; a front bottom roller part including a lower outer bracket and a lower inner bracket which are fitted and fixed to both lower ends of the front door while being connected to each other by a lower connecting bar, and are formed to slide in both lateral directions after moving forward; a rear roller part including rear outer brackets and rear inner brackets which are formed at both upper ends and both lower ends of a rear door formed on one side of the front door, so as to slide the rear door; a front rail part including guide rails which are formed on the upper and lower end surfaces of a rear door frame and the upper and lower surfaces of the rear inner bracket.

11 Claims, 12 Drawing Sheets

(51) Int. Cl.

| | |
|---|---|
| ***E05D 15/06*** | (2006.01) |
| ***E05F 17/00*** | (2006.01) |
| ***E06B 3/46*** | (2006.01) |
| ***E06B 5/20*** | (2006.01) |
| ***E05F 5/00*** | (2017.01) |
| ***E05F 5/08*** | (2006.01) |

(52) U.S. Cl.
CPC ..... *E05D 15/0652* (2013.01); *E05F 5/003* (2013.01); *E05F 5/08* (2013.01); *E05F 17/00* (2013.01); *E05F 17/002* (2013.01); *E06B 3/46* (2013.01); *E06B 5/20* (2013.01); *E05F 2017/005* (2013.01); *E05Y 2201/21* (2013.01); *E05Y 2201/224* (2013.01); *E05Y 2900/20* (2013.01)

(58) Field of Classification Search
CPC ... E05D 2015/1039; E06B 5/20; E06B 3/487; E06B 3/4645; E05F 17/002; E05F 2017/005; E05F 1/16; E05Y 2201/412; E05Y 2201/684; E05Y 2600/46
USPC ..... 49/409, 425, 410
See application file for complete search history.

(56) References Cited

U.S. PATENT DOCUMENTS

| | | | | |
|---|---|---|---|---|
| 6,691,462 | B2 * | 2/2004 | Oestermann | E05B 65/0876 292/36 |
| 8,096,629 | B2 * | 1/2012 | Halfon | E05D 15/0652 312/349 |
| 8,695,165 | B2 * | 4/2014 | Pelekanos | E05D 15/26 16/98 |
| 8,814,282 | B2 * | 8/2014 | Halfon | E05D 15/10 312/139.1 |
| 8,984,810 | B2 * | 3/2015 | Bortoluzzi | E05D 15/1042 312/139 |
| 9,389,011 | B2 * | 7/2016 | Kim | E05D 7/00 |
| 10,087,667 | B2 * | 10/2018 | Girotto | E05D 15/1065 |
| 10,422,570 | B2 * | 9/2019 | Xia | E05D 15/56 |
| 2002/0053166 | A1 * | 5/2002 | Fries | E05B 65/08 49/213 |
| 2006/0225357 | A1 * | 10/2006 | Bortoluzzi | E05D 15/10 49/213 |
| 2012/0260460 | A1 * | 10/2012 | Schmidhauser | E05D 15/1042 16/92 |
| 2014/0082886 | A1 * | 3/2014 | Bortoluzzi | E05D 15/063 16/97 |
| 2015/0068124 | A1 * | 3/2015 | Fornasari | E05D 15/1042 49/130 |
| 2016/0066689 | A1 * | 3/2016 | Terno | E05D 15/0608 312/298 |
| 2016/0312520 | A1 * | 10/2016 | Berger | E06B 3/4663 |
| 2016/0312521 | A1 * | 10/2016 | Berger | E05D 15/1005 |

FOREIGN PATENT DOCUMENTS

| | | |
|---|---|---|
| KR | 100942221 | 2/2010 |
| KR | 101087259 | 11/2011 |
| KR | 101180469 | 9/2012 |
| KR | 101232512 | 2/2013 |

* cited by examiner

SLIDING APPARATUS FOR SLIDING DOOR

BACKGROUND

The present invention relates to a sliding apparatus for a sliding door and, more specifically, to a sliding apparatus for a sliding door, in which when sliding doors for opening or closing the front of furniture or a bathroom cabinet having a storage space slide while overlapping each other, the doors slide through the rails formed at the upper and lower ends of the rear door such that by simply coupling the doors to the conventional rails, the front door and the rear door positioned in a straight line can be opened while overlapping each other so that the compatibility of the product can be increased, the both doors of the sliding doors can be opened or closed at the same time so that the efficient product use is allowed, and when the doors are moved forward or backward, the doors can move while absorbing shock so that the noise of the product can be reduced while improving durability.

In general, various doors are provided on the front of furniture, which have storage spaces and thus can store articles inside, such as a cabinet, a bookcase or a closet, so as to prevent the articles from being seen from the outside.

Such doors can be largely divided into a hinged door type and a sliding door type depending on the opening and closing methods thereof, wherein the hinged door type means that a door is opened or closed while being rotated around a rotary shaft by a hinge, and the sliding door type means that a door is opened or closed by the width of the door along a rail.

Since the door of the hinged door type is rotated as described above, a space corresponding to the width of the door is required, and since the sliding door type requires rails as many as the number of doors and has to maintain a gap between such doors in order to prevent interference between the doors, furniture having the sliding doors has to accommodate such a width for forming the doors.

In order to solve the disadvantages of the opening and closing apparatus of a sliding door as described above, an opening and closing apparatus of a sliding door has been suggested in Korean Patent Registration No. 1180469.

The opening and closing apparatus of a sliding door as described above can slide in both lateral directions and can be stably and smoothly opened and closed with minimized frictional resistance at the time of movement in the back and forth directions, thereby carrying out further stabilized movement in the back and forth directions.

However, this prior art has problems in that in order to ensuring the back and forth movement of the door in the sliding door as described above, a rail frame has to include a straight rail and a curved rail protruding forward so that additional rails have to be installed, resulting in a complicate structure while decreasing productivity.

In addition, since the both side doors have the same tracks along which the doors slide and move back and forth, the both side doors cannot be opened or closed at the same time so that the product efficiency is decreased. Further, since there is no damper for the shock at the time of the back and forth movement of the doors, there are further problems that noise is generated at the time of sliding the doors and the durability of the product is lowered by the shock.

SUMMARY OF THE INVENTION

Accordingly, the present invention has been made in an effort to solve the above-mentioned problems and disadvantages occurring in the prior arts and has an objective to provide a sliding apparatus for a sliding door, in which when the sliding doors slide and overlap each other, by simply coupling the doors to the conventional rail, the front door and the rear door positioned in a straight line can be opened while overlapping each other, thereby increasing the compatibility of the product.

It is another objective of the present invention to provide a sliding apparatus for a sliding door, in which the both doors of the sliding doors can be opened or closed at the same time so that it is possible to use articles stored in either side of furniture or a bathroom cabinet, thereby enabling efficient product use, and when the doors are move forward or backward, the doors can move while absorbing shock so that the noise of the product can be reduced while improving durability.

According to the present invention to achieve the above objectives in order to achieve the above-mentioned objectives, there is provided a sliding apparatus for a sliding door, comprising: a front top roller part including an upper outer bracket and an upper inner bracket which are fitted and fixed to both upper ends of a front door while being connected to each other by an upper connecting bar, and are formed to slide in both lateral directions after moving forward; a front bottom roller part including a lower outer bracket and a lower inner bracket which are fitted and fixed to both lower ends of the front door while being connected to each other by a lower connecting bar, and are formed to slide in both lateral directions after moving forward; a rear roller part including rear outer brackets and rear inner brackets, which are formed at both upper ends and both lower ends of a rear door formed on one side of the front door, so as to slide the rear door; a front rail part including guide rails which are formed on the upper and lower end surfaces of a rear door frame and the upper and lower surfaces of the rear inner bracket, such that the upper inner bracket of the front top roller part and the lower inner bracket of the front bottom roller part slide while moving forward along the guide rails; and a straight rail part including straight rails, which are formed at the upper and lower ends of a housing, so as to slide the front door and the rear door in both lateral directions.

Each of the upper outer bracket and the upper inner bracket of the front top roller part includes upper straight rollers formed at the front and rear portions of the bottom surface of an upper straight body so as to slide along the straight rail of the straight rail part, upper movement bodies are fitted and fixed to both sides of the upper end of the front door so as to slide back and forth by bearings on the inside of the upper straight body, thereby guiding the forward movement of the front door, a damper is formed on the bottom surface of the upper straight body and elastically mounted by a restoring spring, which is connected to the upper straight body and one side of the upper movement body, so as to absorb shock during the movement of the upper movement body, and an upper movement roller is formed on the rear door side of the upper inner bracket so as to move along the guide rail.

The lower outer bracket of the front bottom roller part has a lower straight roller formed on the top surface of a lower straight body so as to slide along the straight rail, a lower movement body is fitted and fixed to the outside of the lower end of the front door so as to slide on the outside of the lower straight body and guide the forward movement of the front door, the outside of the lower movement body and the lower straight body are elastically mounted by a restoring spring, and a lower movement roller is formed on the rear door side of the lower inner bracket so as to move along the guide rail.

Each of the rear outer bracket and the rear inner bracket of the rear roller part includes a rear horizontal roller and connecting rod rollers are formed on the front door side of the rear inner bracket so as to come into rolling contact with the rear portions of the connecting bars and thus slide.

A damping latch is formed to be extended from the rear side of each of the rear outer bracket and the rear inner bracket, which are formed on the lower end of the rear door of the rear roller part, so as to be held by a damper.

A handle is formed on each of the bottom surfaces of the rear outer bracket formed at the lower end of the rear door of the rear roller part and the lower outer bracket of the front bottom roller part so as to protrude to the lower portion of each of the front door and the rear door.

The guide rail formed on the rear door frame of the front rail part is formed to be straight and the guide rail of the rear inner bracket, which is connected to the guide rail, is formed as a curved rail that is curved backward.

The upper straight roller is formed to be parallel to the front door and the upper movement roller is formed to be perpendicular.

A latch is formed on the rear side of the upper straight body of each of the upper outer bracket and the upper inner bracket so as to be held by a damper.

The lower straight roller and the lower movement roller are formed to be perpendicular to the front door.

The rear horizontal roller formed on each of the rear outer bracket and the rear inner bracket at the upper end of the rear door of the rear roller part is formed to be parallel to the rear door, and the connecting rod and the rear horizontal roller formed on the rear inner bracket and the rear outer bracket at the lower end of the rear door are formed to be perpendicular to the rear door.

As described above, according to the present invention, when the sliding doors slide and overlap each other, by simply coupling the doors to the conventional rail, the front door and the rear door positioned in a straight line can be opened while overlapping each other, thereby increasing the compatibility of the product, the both doors of the sliding doors can be opened or closed at the same time so that it is possible to use articles stored in either side of furniture or a bathroom cabinet, thereby enabling efficient product use, and when the doors are moved forward or backward, the doors can move while absorbing shock so that the noise of the product can be reduced while improving durability.

While the present invention has been particularly shown and described with reference to exemplary embodiments thereof, it is to be understood that the invention is not limited to the disclosed exemplary embodiments, but, on the contrary, various changes and modifications may be made within the spirit of the present invention by those skilled in the art, to which the present invention belongs.

BRIEF EXPLANATION OF REFERENCE SYMBOLS

| | |
|---|---|
| 10: front top roller part | 11: front door |
| 12: upper outer bracket | 13: upper inner bracket |
| 14: upper connecting bar | 20: front bottom roller part |

-continued

| | |
|---|---|
| 21: lower outer bracket | 22: lower inner bracket |
| 23: lower connecting bar | 30: rear roller part |
| 31: rear door | 32: rear outer bracket |
| 33: rear inner bracket | 40: front rail part |
| 41: guide rail | 50: straight rail part |
| 51: straight rail | 60: handle |

DETAILED DESCRIPTION OF THE INVENTION

In order to fully understand the advantages in the operations of the present invention and the objectives achieved by the implementation of the present invention, reference should be made to the accompanying drawings, which show preferred embodiments of the present invention, and the contents of the accompanying drawings.

Hereinafter, the present invention will be described in more detail with reference to specific examples of the present invention. The following examples are provided to explain the present invention in more detail, but the technical scope of the present invention is not limited thereto.

Embodiments

Figure 18:
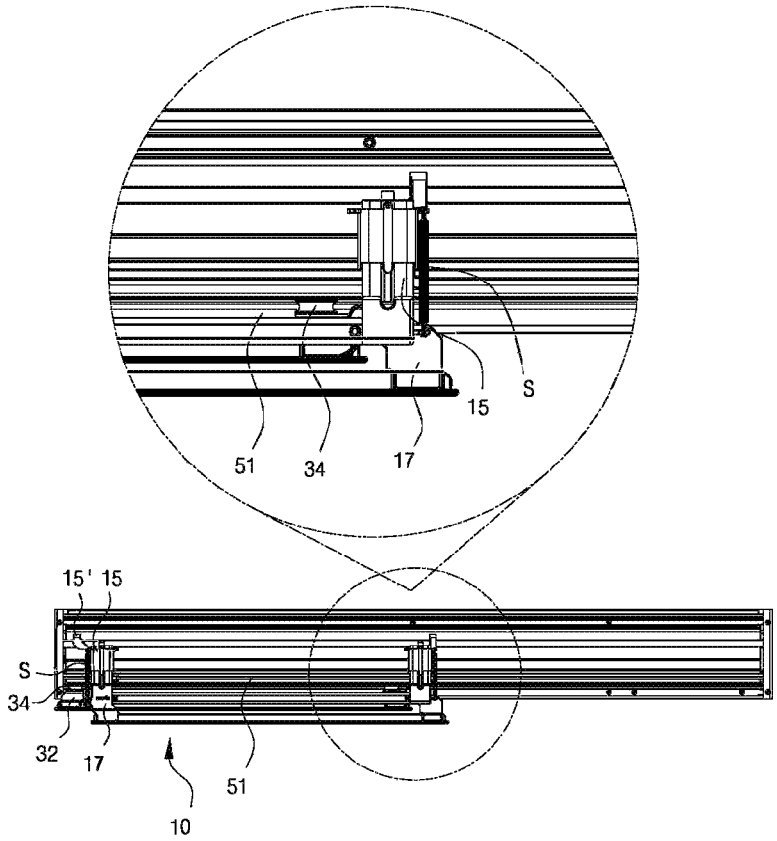
FIG. 18 is a plane view showing an opened state of a sliding apparatus for a sliding door according to the present invention.

FIG. 18 is an assembly diagram showing a sliding apparatus for a sliding door according to the present invention.

As illustrated, a sliding apparatus for a sliding door according to the present invention includes a front top roller part 10 and a front bottom roller part 20 for opening or closing a front door 11, a rear roller part 30 formed on a rear door 31, a front rail part 40 along which the front top roller part 10 and the front bottom roller part 20 slide, and a straight rail part 50 along which the front and rear doors 11, 31 slide.

Figure 1:
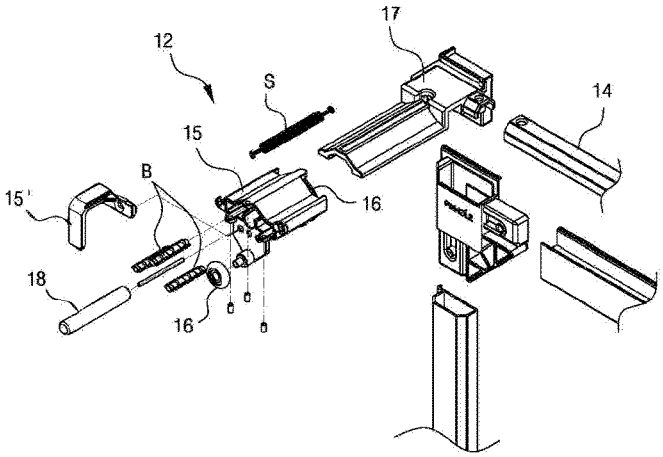
FIG. 1 is an exploded perspective view showing an upper outer bracket of a sliding apparatus for a sliding door according to the present invention.
Figure 2:
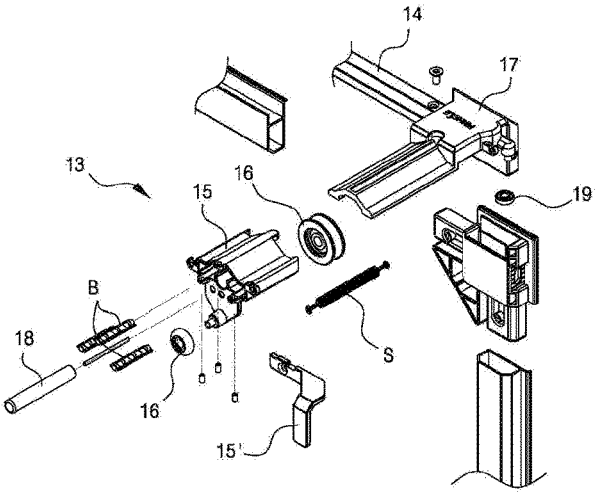
FIG. 2 is an exploded perspective view showing an upper inner bracket of a sliding apparatus for a sliding door according to the present invention.
Figure 3:
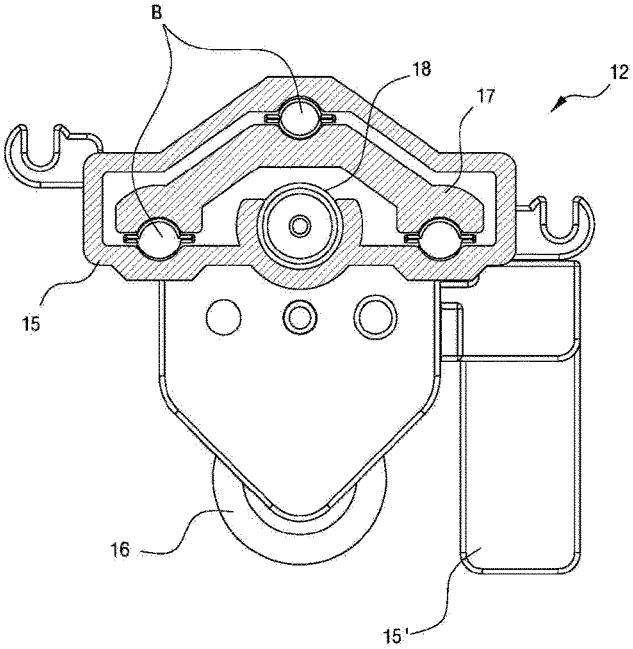
FIG. 3 is a cross-sectional view showing an upper inner bracket of a sliding apparatus for a sliding door according to the present invention.

As shown in FIG. 1 to FIG. 3, the front top roller part 10 as described above includes an upper outer bracket 12 and upper inner bracket 13 which are fitted and fixed to both upper ends of the front door 11 while being connected to each other by an upper connecting bar 14.

The upper outer bracket 12 and the upper inner bracket 13 of the front top roller part 10 include upper straight rollers 16 formed at the front and rear portions of the bottom surface of an upper straight body 15 so as to slide along the straight rail 51 of the straight rail part 50, and upper movement bodies 17 are fitted and fixed to both sides of the upper end of the front door 11 so as to slide back and forth by bearings B on the inside of the upper straight body 15, thereby guiding the forward movement of the front door 11.

A damper 18 is formed on the bottom surface of the upper straight body 15 and elastically mounted by a restoring spring S, which is connected to the upper straight body 15 and one side of the upper movement body 17, so as to absorb shock during the movement of the upper movement body 17, and an upper movement roller 19 is formed on the inside and perpendicular to the front door 11.

In addition, a latch 15' is formed on the rear side of the upper straight body 15 of each of the upper outer bracket 12 and the upper inner bracket 13 so as to be held by a damper formed at the upper side of a housing.

The front bottom roller part 20 is formed at both sides on the lower end of the front door 11 respectively.

Figure 4:
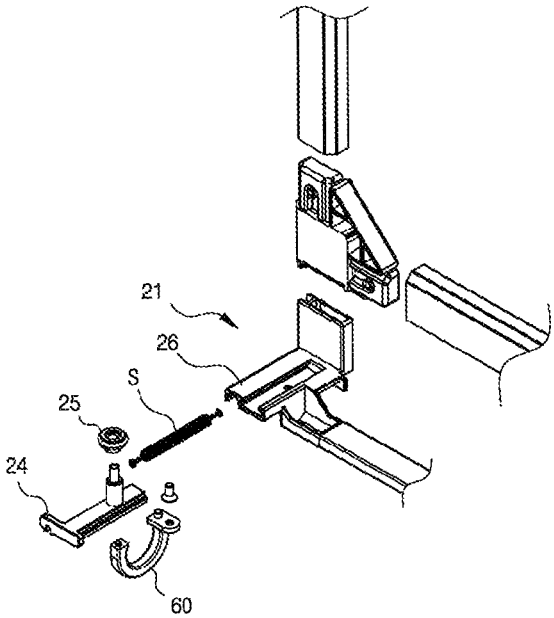
FIG. 4 is an exploded perspective view showing a lower inner bracket of a sliding apparatus for a sliding door according to the present invention.
Figure 5:
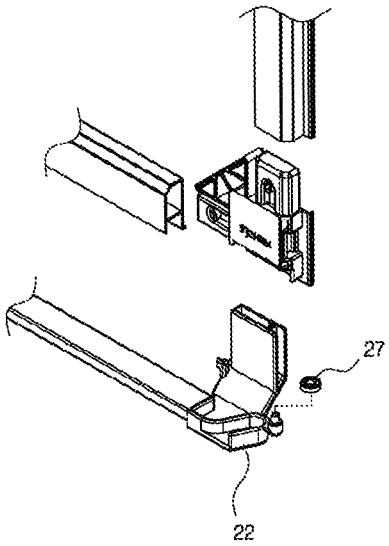
FIG. 5 is an exploded perspective view showing a lower outer bracket of a sliding apparatus for a sliding door according to the present invention.
Figure 6:
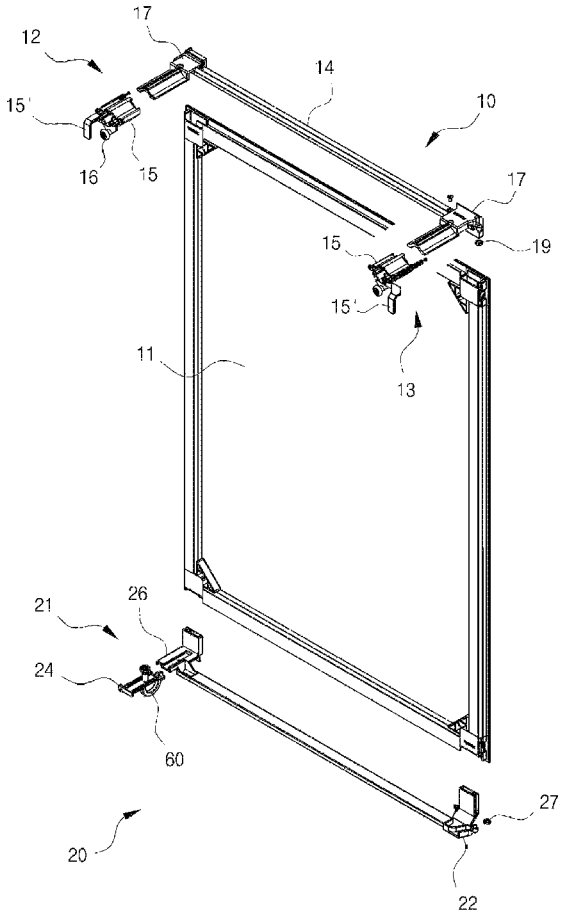
FIG. 6 is an exploded perspective view showing a front door of a sliding apparatus for a sliding door according to the present invention.
Figure 7:
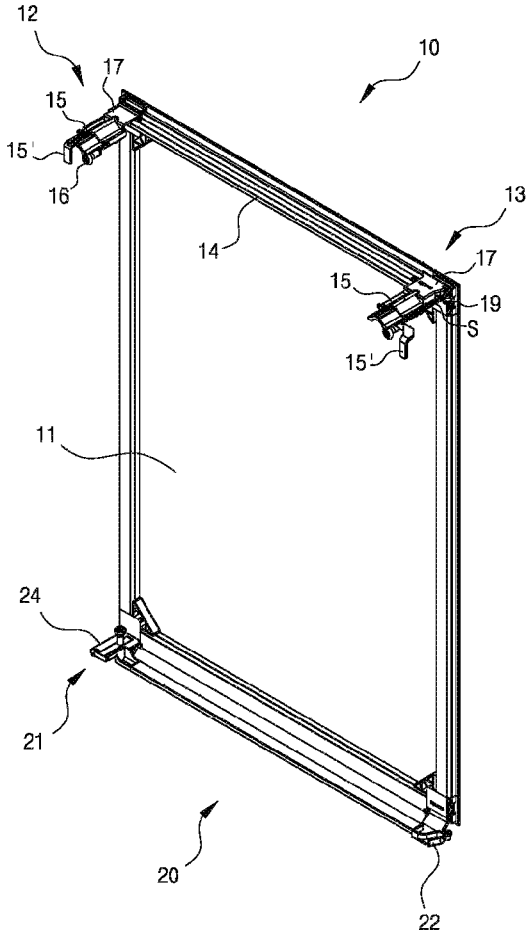
FIG. 7 is a perspective view showing a front door of a sliding apparatus for a sliding door according to the present invention.
Figure 8:
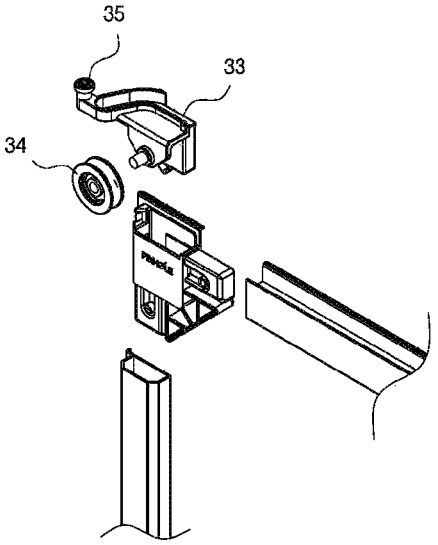
FIG. 8 is an exploded perspective view showing a rear inner bracket at the upper end of a rear door of a sliding apparatus for a sliding door according to the present invention.
Figure 9:
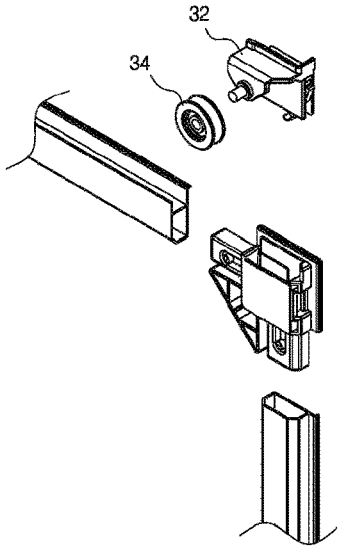
FIG. 9 is an exploded perspective view showing a rear outer bracket at the upper end of a rear door of a sliding apparatus for a sliding door according to the present invention.
Figure 10:
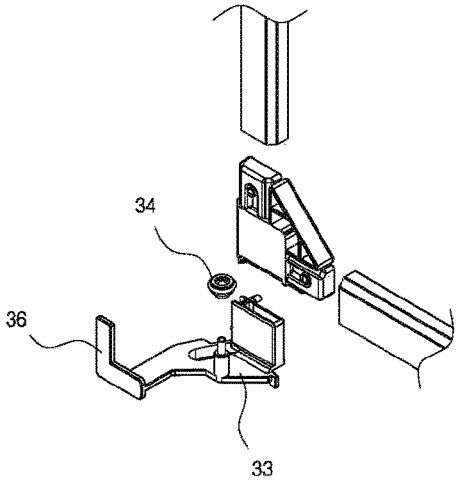
FIG. 10 is an exploded perspective view showing a rear inner bracket at the lower end of a rear door of a sliding apparatus for a sliding door according to the present invention.
Figure 11:
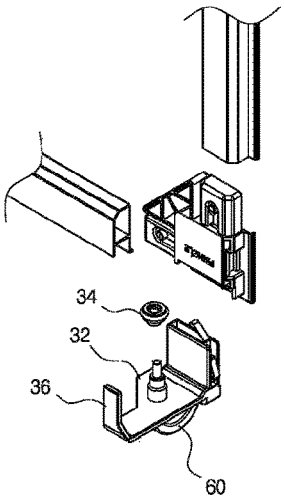
FIG. 11 is an exploded perspective view showing a rear outer bracket at the lower end of a rear door of a sliding apparatus for a sliding door according to the present invention.
Figure 12:
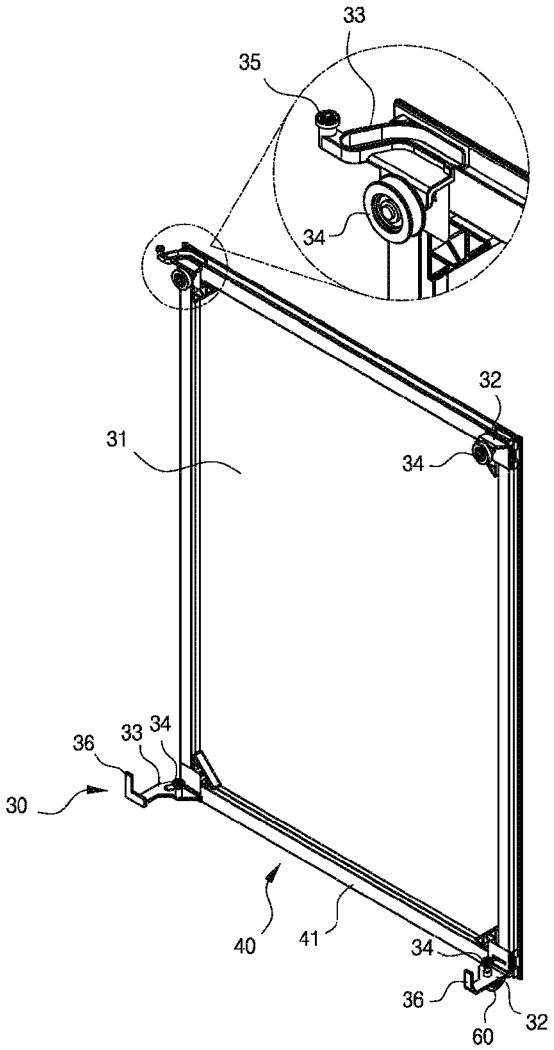
FIG. 12 is an assembled perspective view showing a rear door according to a sliding apparatus for a sliding door according to the present invention.
Figure 13:
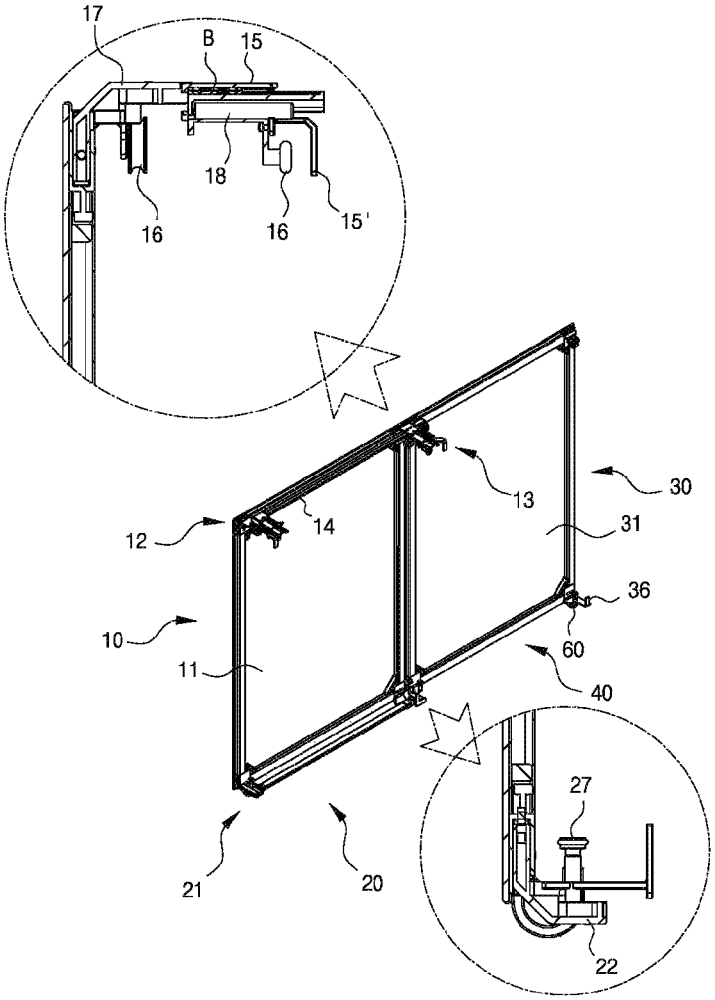
FIG. 13 is an explanatory view showing the upper and lower outer brackets of a sliding apparatus for a sliding door according to the present invention, when doors are closed.
Figure 14:
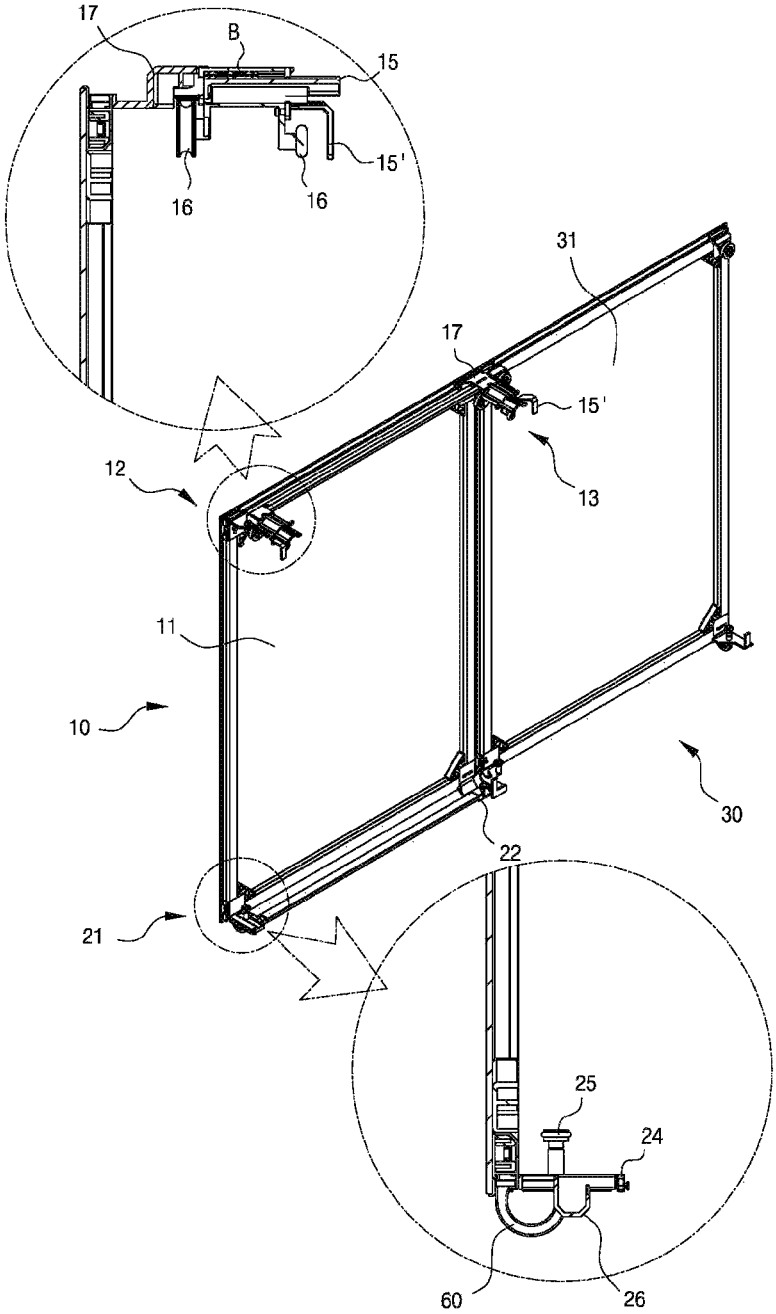
FIG. 14 is an explanatory view showing the upper and lower inner brackets of a sliding apparatus for a sliding door according to the present invention, when doors are closed.

As shown in FIG. 4 to FIG. 5, the front bottom roller part 20 as above includes a lower outer bracket 21 and a lower inner bracket 22 which are fitted and fixed to both sides of the lower end of the front door 11 while being connected to each other by a lower connecting bar 23, and are formed to slide in both lateral directions after moving forward.

The lower outer bracket 21 of the front bottom roller part 20 as described above includes a lower straight roller 25, which is formed on the top surface of a lower straight body 24 so as to slide along the straight rail 51, and a lower movement body 26, which is fitted and fixed to the outside of the lower end of the front door 11 so as to slide on the outside of the lower straight body 24 and thus guide the forward movement of the front door 11.

The outside of the lower movement body 26 and the lower straight body 24 are elastically mounted by a restoring spring S, and a lower movement roller 27 is formed on the lower inner bracket 22 so as to be perpendicular to the front door 11.

The rear roller part 30 is formed on the rear door 31 formed at one side of the front door 11.

As shown in FIG. 8 to FIG. 12, the rear roller part 30 includes rear outer brackets 32 and rear inner brackets 33 which are formed at both upper ends and both lower ends of the rear door 31 so as to slide the rear door 31.

Each of the rear outer bracket 32 and the rear inner bracket 33 of the rear roller part 30 includes a rear horizontal roller 34 and a connecting rod roller 35 is formed on the front door 11 side of the rear inner bracket 33 so as to come into rolling contact with the rear portion of the connecting bar 23 and thus slide.

In addition, a damping latch 36 is formed to be extended from the rear side of each of the rear outer bracket 32 and the rear inner bracket 33, which are formed on the lower end of the rear door 31 of the rear roller part 30, so as to be held by a damper.

A handle 60 is formed on each of the bottom surfaces of the rear outer bracket 31 formed at the lower end of the rear door 31 of the rear roller part 30 and the lower outer bracket 21 of the front bottom roller part 20 so as to protrude to the lower portion of each of the front door 11 and the rear door 31.

The rear horizontal roller 34 formed on each of the rear outer bracket 32 and the rear inner bracket 33 at the upper end of the rear door 31 of the rear roller part 30 is formed to be parallel to the rear door 31, and the connecting rod roller 35 and the rear horizontal roller 34 formed on the rear inner bracket 33 and the rear outer bracket 32 at the lower end of the rear door 31 are formed to be perpendicular to the rear door 31.

The front rail part 40 is formed such that the upper inner bracket 13 of the front top roller part 10 and the lower inner bracket 22 of the front bottom roller part 20 slide while moving forward.

The front rail part 40 includes guide rails 41 which are formed on the upper and lower end surfaces of a rear door frame 34 and the upper and lower surfaces of the rear inner bracket 33, wherein the guide rail 41 formed on the rear door frame 34 of the front rail part 40 is formed to be straight and the guide rail 41 of the rear inner bracket 33, which is connected to the guide rail 41, is formed as a curved rail that is curved backward.

Figure 15:
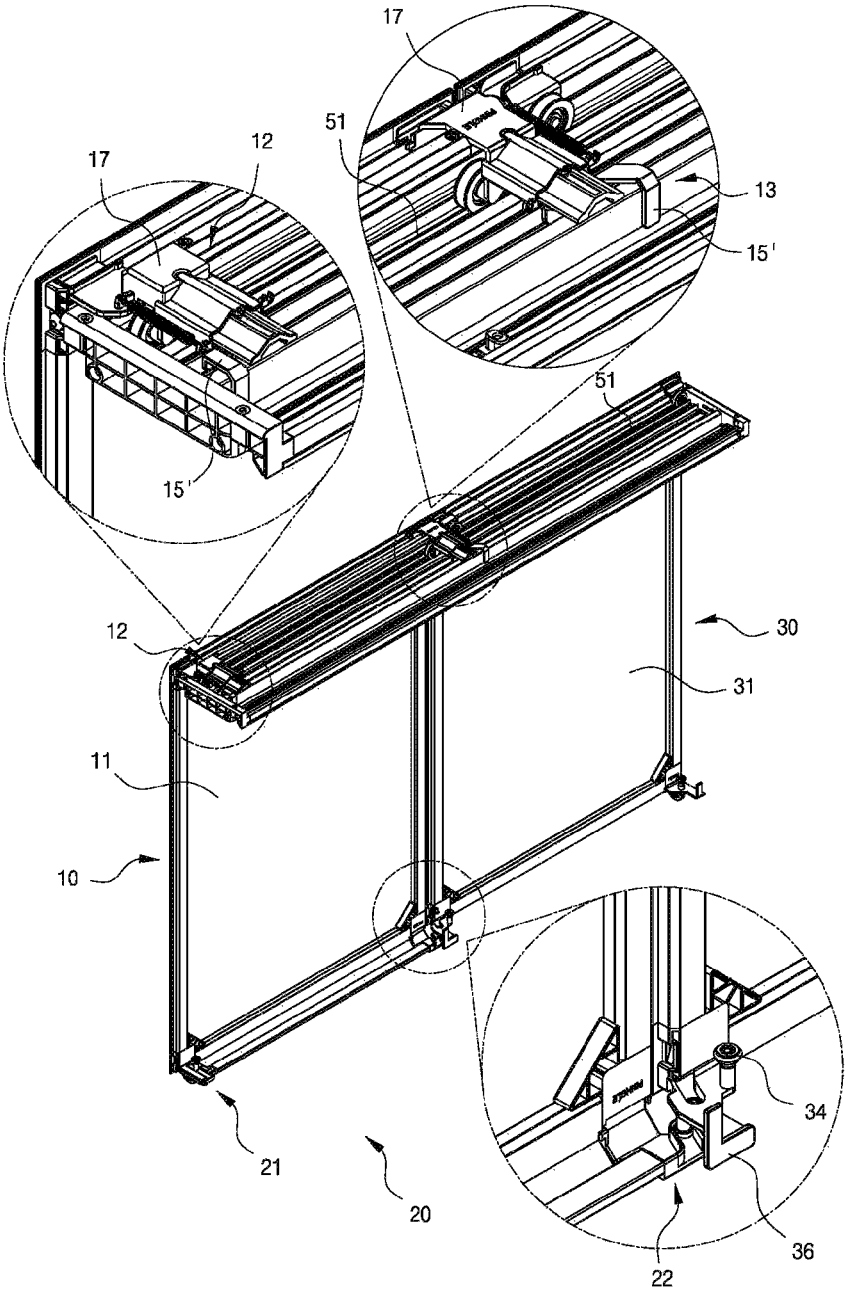
FIG. 15 is a perspective view showing a sliding apparatus for a sliding door according to the present invention, which is applied to a straight rail.
Figure 16:
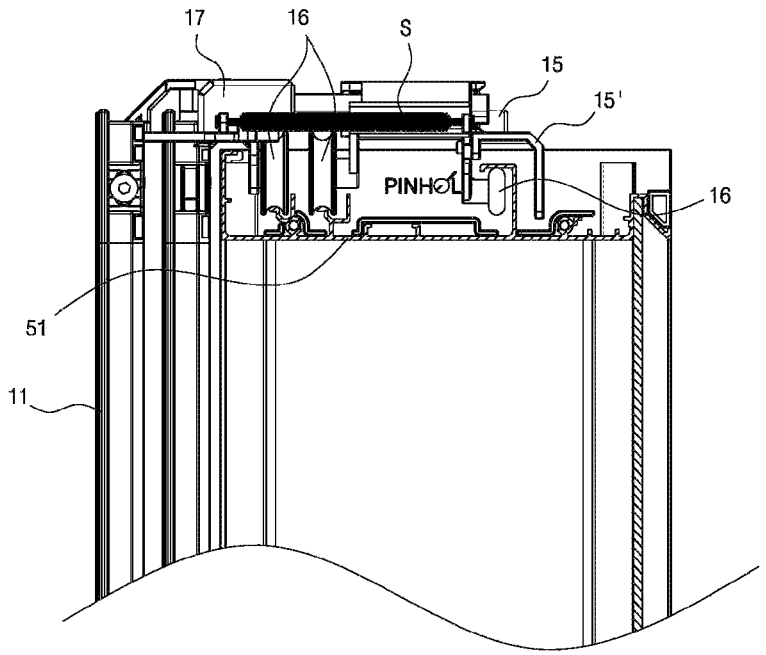
FIG. 16 is a cross-sectional view showing a sliding apparatus for a sliding door according to the present invention, which is applied to a straight rail.
Figure 17:
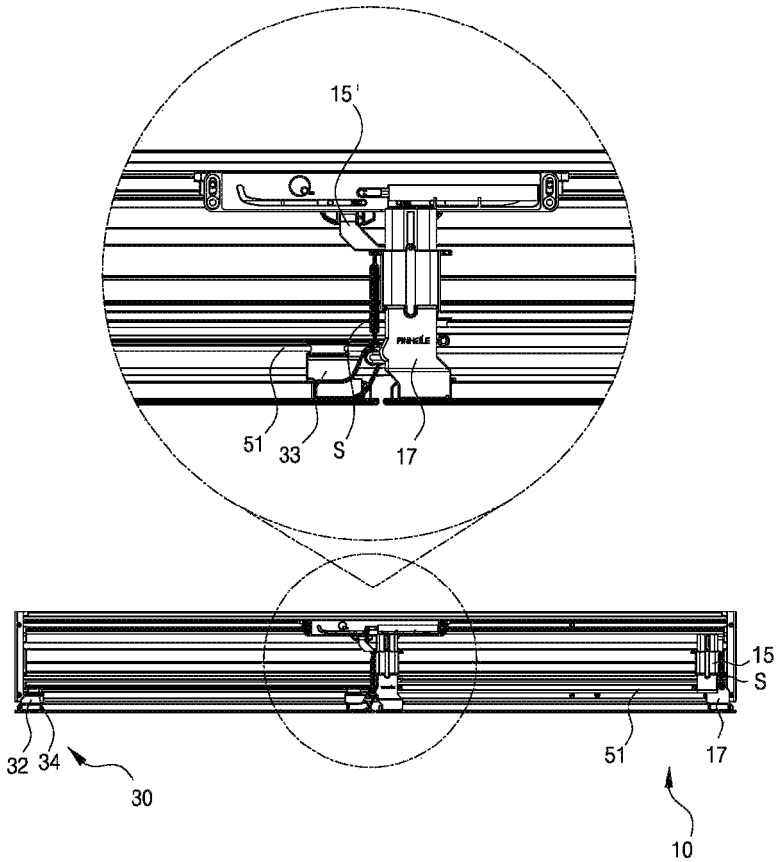
FIG. 17 is a plane view showing a closed state of a sliding apparatus for a sliding door according to the present invention.

Meanwhile, as shown in FIG. 15 to FIG. 16, the straight rail part 50 is formed such that the front door 11 and the rear door 31 slide in both lateral directions, wherein the straight rail part 50 includes the straight rails 51 formed on the upper and lower ends of the housing.

The operation and effect of the present invention structured as above will be described below.

First, the front door 11 and the rear door 31 are formed on the front surface of the housing, which has a storage space.

In order to locate the front door 11 and the rear door 31 on the same straight line when the housing is closed and to maintain the front door 11 and the rear door 31 in an overlapping state when opened by sliding doors, as shown in FIG. 18, the front door 11 and the rear door 13 are maintained in the overlapping state while the upper outer bracket 12 and the upper inner bracket 13, which are fixed to the front door 11, and the upper movement body 17 and the lower movement body 26 of the lower outer bracket 21 slidingly move forward.

Herein, in order to enable the front door 11 to overlap the rear door 31 in front of the rear door 31, the upper movement roller 19 formed on the upper movement body 17 of the upper inner bracket 13 moves along the upper end surface of the rear door frame 34 of the rear door 31 and the guide rail 41 formed on the upper surface of the rear inner bracket 33, and the lower movement roller 27 formed on the lower inner bracket 22 moves along the lower end surface of the rear door frame 34 of the rear door 31 and the guide rail 41 formed on the lower surface of the rear inner bracket 33.

The front door 11 is opened or closed while moving forward along the guide rail 41 as described above.

When the front door 11 moves as described above, the connecting rod rollers 35 formed on the rear inner brackets 33 come into rolling contact with the rear portions of the upper connecting bar 14, which connects the upper outer bracket 12 and the upper inner bracket 13 fixed on the front door 11, and the lower connecting bar 23, which connects the lower outer bracket 21 and the lower inner bracket 22, thereby increasing stability during opening or closing.

The front door 11 and the rear door 31 are opened while overlapping each other even if the front door 11 and the rear door 31 are opened simultaneously, as the front door 11 moves along the guide rail 41 formed on the rear door 31 as described above.

Figure 19:
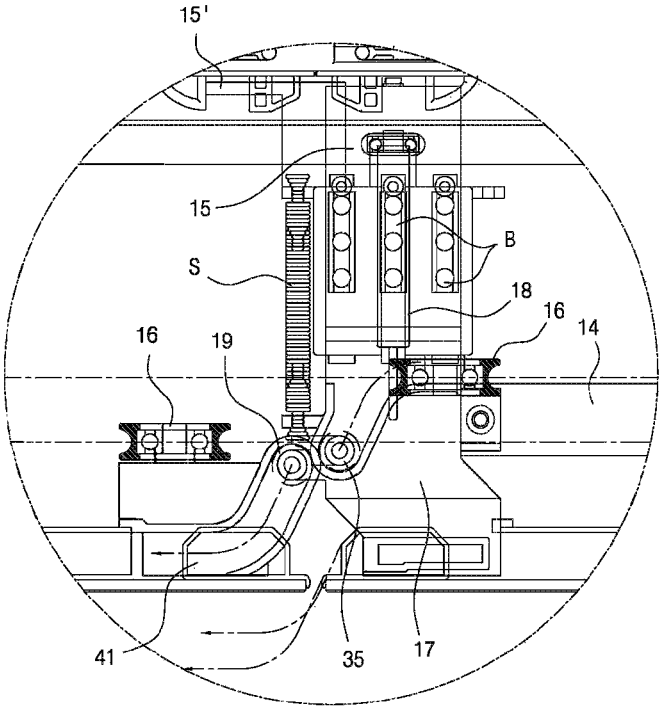
FIG. 19 is an explanatory view showing the upper inner end surface of a sliding apparatus for a sliding door according to the present invention, when doors are closed.
Figure 20:
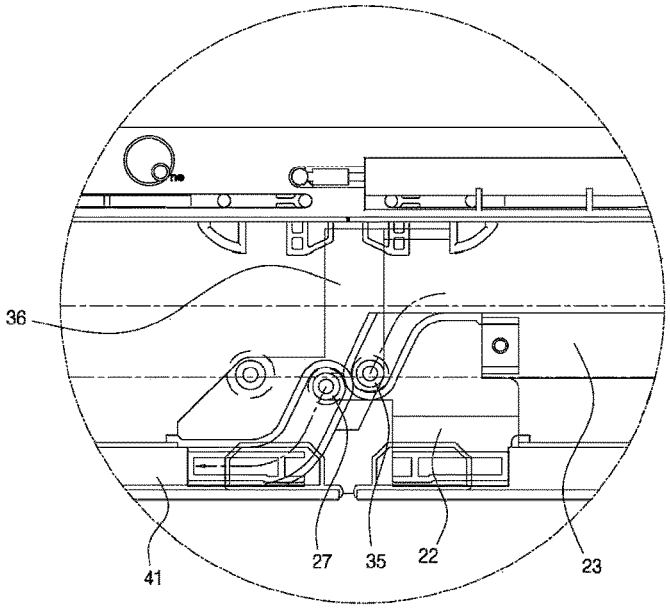
FIG. 20 is an explanatory view showing the lower inner end surface of a sliding apparatus for a sliding door according to the present invention, when doors are closed.
Figure 21:
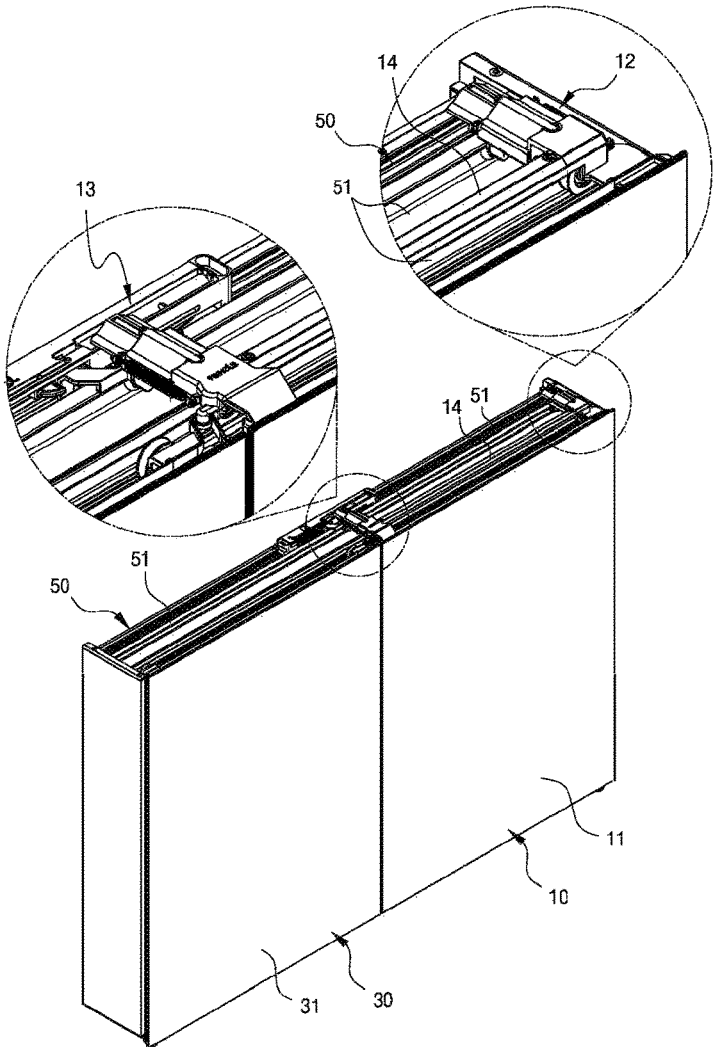
FIG. 21 is an assembly diagram of a sliding apparatus for a sliding door according to the present invention.

The upper movement roller 19 formed on the upper end of the front door 11 and the connecting rod roller 35 formed on the rear door 31, which move as above as shown in FIG. 19 an FIG. 20, come into surface contact with each other without any planar gap between the rollers such that the doors can be opened or closed stably without shaking and the front door 11 and the rear door 31 can be opened or closed simultaneously while rolling.

In addition, the lower movement roller 27 and the connecting rod roller 35 on the inner rear ends of the front door 11 and the rear door 31, which are opened and closed as described above, are formed to roll without any planar gap between the rollers such that the doors can be opened or closed stably without shaking and the front door 11 and the rear door 31 can be simultaneously opened or closed simultaneously while rolling.

Further, the upper straight rollers 16, which are formed on the upper straight bodies 15 of the upper outer bracket 12 and the upper inner bracket 13 of the front door 11, and the lower straight roller 25 on the lower straight body 24 of the lower outer bracket 21 slide along the straight rails 51.

The rear horizontal rollers 34 formed on the rear outer bracket 32 and the rear inner bracket 33 come into rolling contact with the straight rail 51 and slide along the straight rail 51 such that the rear door 31 moves.

If the front door 11 and the rear door 31 overlap as described above, the restoring spring S which is formed on the upper straight body 15 and the upper movement body 17 and the restoring spring S which connects the lower straight body 24 and the lower movement body 25 are maintained in a tensioned state.

If the front door 11 and the rear door 31 are positioned on the same line in this state so as to close the housing, the front door 11 and the rear door 31 slide in the same manner as the sliding manner described above and the upper straight body 15 and the upper movement body 17 as well as the lower straight body 24 and the lower movement body 25 are inserted into and returned to the original positions thereof by the restoring force of the restoring spring S which is formed on the upper straight body 15 and the upper movement body 17 and the restoring spring S which connects the lower straight body 24 and the lower movement body 25

Herein, the shock when the front door 11 is returned to the original position thereof is absorbed as the damper 18 formed on the bottom surface of the upper straight body 15 absorbs the shock in the movement of the upper movement body 17.

The opening or closing of the doors as described above can be carried out by holding the handles 60 formed on the rear outer bracket 31 and the lower outer bracket 21 so that the opening or closing can be carried out conveniently, and the latch 15' of the upper straight body 15 and the damping latches 36 formed on the rear side of the rear outer bracket 32 and the rear inner bracket 33 are formed to be held on the damper formed on the upper and lower ends of the housing such that the shock at the time of opening or closing the doors can be absorbed.

The invention claimed is:

1. A sliding apparatus for a sliding door, comprising: a front top roller part (10) including an upper outer bracket (12) and an upper inner bracket (13) which are fitted and fixed to both upper ends of a front door (11) while being connected to each other by an upper connecting bar (14), and are formed to slide in both lateral directions after moving forward; a front bottom roller part (20) including a lower outer bracket (21) and a lower inner bracket (22) which are fitted and fixed to both lower ends of the front door (11) while being connected to each other by a lower connecting bar (23), and are formed to slide in both lateral directions after moving forward; a rear roller part (30) including rear outer brackets (32) and rear inner brackets (33) which are formed at both upper ends and both lower ends of a rear door (31) formed on one side of the front door (11), so as to slide the rear door (31); a front rail part (40) including guide rails (41) which are formed on the upper and lower end surfaces of a rear door frame (34) and the upper and lower surfaces of the rear inner bracket (33), such that the upper inner bracket (13) of the front top roller part (10) and the lower inner bracket (22) of the front bottom roller part (20) slide while moving forward along the guide rails (41); and a straight rail part (50) including straight rails (51) which are formed at the upper and lower ends of a housing, so as to slide the front door (11) and the rear door (31) in both lateral directions.

2. The sliding apparatus for a sliding door according to claim 1, wherein each of the upper outer bracket (12) and the upper inner bracket (13) of the front top roller part (10) includes upper straight rollers (16) formed at the front and rear portions of a bottom surface of an upper straight body (15) so as to slide along the straight rail (51) of the straight rail part (50), upper movement bodies (17) are fitted and fixed to both sides of the upper end of the front door (11) so as to slide back and forth by bearings on an inside of the upper straight body (15), thereby guiding the forward movement of the front door (11), a damper (18) is formed on a bottom surface of the upper straight body (15) and elastically mounted by a restoring spring (S), which is connected to the upper straight body (15) and one side of the upper movement body (17), so as to absorb shock during the movement of the upper movement body (17), and an upper movement roller (19) is formed on the rear door (31) side of the upper movement body (17) of the upper inner bracket (13) so as to move along the guide rail (41).

3. The sliding apparatus for a sliding door according to claim 2, wherein the upper straight roller (16) is formed to be parallel to the front door (11) and the upper movement roller (19) is formed to be perpendicular.

4. The sliding apparatus for a sliding door according to claim 2, wherein a latch (15') is formed on a rear side of the upper straight body (15) of each of the upper outer bracket (12) and the upper inner bracket (13) so as to be held by a damper.

5. The sliding apparatus for a sliding door according to claim 1, wherein the lower outer bracket (21) of the front bottom roller part (20) has a lower straight roller (25) formed on a top surface of a lower straight body (24) so as to slide along the straight rail (51), a lower movement body (26) is fitted and fixed to an outside of the lower end of the front door (11) so as to slide on an outside of the lower straight body (24) and guide the forward movement of the front door (11), an outside of the lower movement body (26) and the lower straight body (24) are elastically mounted by a restoring spring (S), and a lower movement roller (27) is formed on the rear door (31) side of the lower inner bracket (22) so as to move along the guide rail (41).

6. The sliding apparatus for a sliding door according to claim 5, wherein the lower straight roller (25) and the lower movement roller (27) are formed to be perpendicular to the front door (11).

7. The sliding apparatus for a sliding door according to claim 1, wherein each of the rear outer bracket (32) and the rear inner bracket (33) of the rear roller part (30) includes a rear horizontal roller (34) so as to slide along the straight rail (51), and connecting rod rollers (35) are formed on the front door (11) side of the rear inner brackets (33) so as to come into rolling contact with the rear portion of the upper connecting bar (14) and the lower connecting bar (23) and thus slide.

8. The sliding apparatus for a sliding door according to claim 7, wherein the rear horizontal roller (34) formed on each of the rear outer bracket (32) and the rear inner bracket (33) at the upper end of the rear door (31) of the rear roller part (30) is formed to be parallel to the rear door (31), and the connecting rod roller (35) and the rear horizontal roller (34) formed on the rear inner bracket (33) and the rear outer bracket (32) at a lower end of the rear door (31) are formed to be perpendicular to the rear door (31).

9. The sliding apparatus for a sliding door according to claim 1, wherein a damping latch (36) is formed to be extended from an rear side of each of the rear outer bracket (32) and the rear inner bracket (33), which are formed on the lower end of the rear door (31) of the rear roller part (30), so as to be held by a damper.

10. The sliding apparatus for a sliding door according to claim 1, wherein a handle (60) is formed on each of a bottom surfaces of the rear outer bracket (31) formed at the lower end of the rear door (31) of the rear roller part (30) and the lower outer bracket (21) of the front bottom roller part (20) so as to protrude to the lower portion of each of the front door (11) and the rear door (31).

11. The sliding apparatus for a sliding door according to claim 1, wherein the guide rail (41) formed on the rear door frame (34) of the front rail part (40) is formed to be straight and the guide rail (41) of the rear inner bracket (33), which is connected to the guide rail (41), is formed as a curved rail that is curved backward.

* * * * *